United States Patent [19]

Martin et al.

[11] 4,096,809

[45] Jun. 27, 1978

[54] APPARATUS FOR COMPENSATING FOR THERMALLY INDUCED DEFORMATION OF SECTIONS OF GRATES IN INDUSTRIAL FURNACES OR THE LIKE

[75] Inventors: Johannes Josef Martin; Erich Weber, both of Munich, Germany

[73] Assignee: Josef Martin Feuerungsbau GmbH, Munich, Germany

[21] Appl. No.: 797,186

[22] Filed: May 16, 1977

[30] Foreign Application Priority Data

May 21, 1976 Germany ..... 2622965

[51] Int. Cl.[2] ..... F23H 11/00

[52] U.S. Cl. ..... 110/271; 266/179; 432/245

[58] Field of Search ..... 266/179, 185, 279; 432/245; 110/40 R, 40 E, 40 C, 44

[56] References Cited

U.S. PATENT DOCUMENTS 1,563,762 12/1925 Lundgren ..... 110/44
1,832,888 11/1931 Zinkernagel ..... 110/40

FOREIGN PATENT DOCUMENTS 564,146 11/1932 Germany ..... 110/40
1,169,754 11/1969 United Kingdom ..... 110/40

*Primary Examiner*—Kenneth W. Sprague
*Attorney, Agent, or Firm*—Peter K. Kontler

[57] ABSTRACT

Apparatus which compensates for thermally induced changes in the width of gaps between longitudinally extending marginal portions of grate sections in industrial furnaces has two rows of plate-like cheeks which abut against the marginal portions of neighboring sections and can swivel on fulcra defined by the webs of inverted U-shaped supporting devices whose legs are turnable about pivots mounted in a frame and extending in parallelism with the marginal portions of grate sections. The cheeks are urged away from each other and against the marginal portions of neighboring grate sections by pairs of two-armed levers mounted on a common shaft which is biased downwardly by a package of dished springs through the medium of a pull rod. The cheeks of each row are secured to plate-like carriers which are disposed between the respective rows of cheeks and the corresponding arms of the levers and are swingable on the associated fulcra. The upper portions of cheeks which face each other define orifices for discharge of heated or cooling gases into the spaces above the neighboring grate sections.

25 Claims, 6 Drawing Figures

APPARATUS FOR COMPENSATING FOR THERMALLY INDUCED DEFORMATION OF SECTIONS OF GRATES IN INDUSTRIAL FURNACES OR THE LIKE

BACKGROUND OF THE INVENTION

The present invention relates to improvements in apparatus for filling clearances between neighboring structural elements at least one of which is subject to thermally induced expansion or contraction. Such apparatus can be used with advantage in grates of industrial furnaces to compensate for thermally induced lateral expansion or contraction of neighboring grate sections. More particularly, the invention relates to improvements in compensating apparatus of the type wherein one or more cheeks or analogous component parts are swingable or pivotable in response to sidewise movement of elongated marginal portions of structural elements as a result of thermally induced deformation of such elements.

German Pat. No. 564,146 discloses a compensating apparatus wherein a box-shaped member is placed between a grate section and a wall portion of a combustion chamber for coal, coke or another type of fuel. The member receives gaseous oxygen-containing fluid and has outlet openings which discharge such fluid into the space below the neighboring grate section to promote the combustion of fuel thereon. The upper portion of the box-shaped member is swingable on a fulcrum and the lower portion of the member is urged against the grate section by a weight or by resilient means. A serious drawback of the patented compensating apparatus is that the fulcrum must be located well above the level of the grate section in order to insure that the box-shaped member will be capable of remaining substantially parallel to the edge face of the neighboring marginal portion of the grate section when the marginal portion moves sideways in response to heating or cooling. If the fulcrum is not located at a level well above the grate section, friction between the member and the grate section can reach a value at which the member jams and is incapable of filling the gap between the grate section and the wall of the combustion chamber. Moreover, the just described apparatus can be used only to fill a gap between a deformable structural element and a fixedly mounted non-deformable part (e.g., the wall of a furnace or the like).

German Pat. No. 1,451,519 discloses modified compensating apparatus which can be used between the wall of a combustion chamber and a grate or between neighboring sections of a composite grate. The apparatus comprise telescoped beams which move relative to each other in response to variations in distance between neighboring grate sections. Such apparatus are quite satisfactory under normal circumstances; however, friction between the beams and their stationary supports is quite pronounced, i.e., the beams are likely to jam in response to tilting relative to their support.

OBJECTS AND SUMMARY OF THE INVENTION

An object of the invention is to provide a novel and improved apparatus which can fill the gaps between stationary structural elements (such as the walls of a combustion chamber) and structural elements which undergo pronounced deformation in response to temperature changes, or between neighboring structural elements each of which tends to expand or contract in response to rise or fall of its temperature.

Another object of the invention is to provide an apparatus which operates satisfactorily within an extremely wide range of temperatures and is less likely to jam, even at very high temperatures, then heretofore known apparatus.

A further object of the invention is to provide an apparatus which can be installed in existing industrial furnaces or analogous plants as a superior substitute for presently known apparatus serving to fill the gaps between structural elements which are subjected to thermal stresses within a wide range and tend to expand or contract as a result of temperature changes.

An additional object of the invention is to provide the appartus with novel and improved means which enable its element-contacting parts to remain in continuous contact with the adjacent structural elements regardless of the width of gaps between such elements.

An ancillary object of the invention is to provide novel and improved means for biasing the aforementioned parts of the apparatus into contact with the adjacent structural elements, such as sections of the grate in an industrial furnace.

The invention is embodied in an apparatus for compensating for thermally induced dimensional changes of sections of grates in industrial furnaces or of analogous structural elements of the type having an elongated marginal portion extending substantially transversely of the direction of thermally induced expansion or contraction. The apparatus comprises at least one side wall (e.g., a cheek consisting of a highly heat-resistant material) adjacent to the marginal portion of a structural element (e.g., an elongated section of a grate) which is subject to expansion or contraction, means (e.g., an inverted U-shaped member) for swingably supporting the side wall including a fulcrum (e.g., the web of the aforementioned U-shaped member) extending in substantial parallelism with the marginal portion of the structural element, guide means for the supporting means (such guide means may include a frame and a pivot mounted in the frame and turnably supporting the lower end portions of the legs of the aforementioned U-shaped member so that the fulcrum of the supporting means is movable with respect to the guide means substantially at right angles to the marginal portion of the structural element which is adjacent the side wall), and means for yieldably biasing the side wall against the marginal portion of the adjacent structural element. The biasing means may comprise a plate-like carrier which is adjacent to and abuts against the side wall opposite the marginal portion of the structural element, a system of levers each having an arm which abuts against that side of the carrier which faces away from the side wall, and means for urging the common pivot for the lever sideways to thereby bias the arms of the levers against the carrier. If the biasing means comprises a carrier, the latter is preferably swingable on the fulcrum of the supporting means and the side wall is secured to the carrier.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
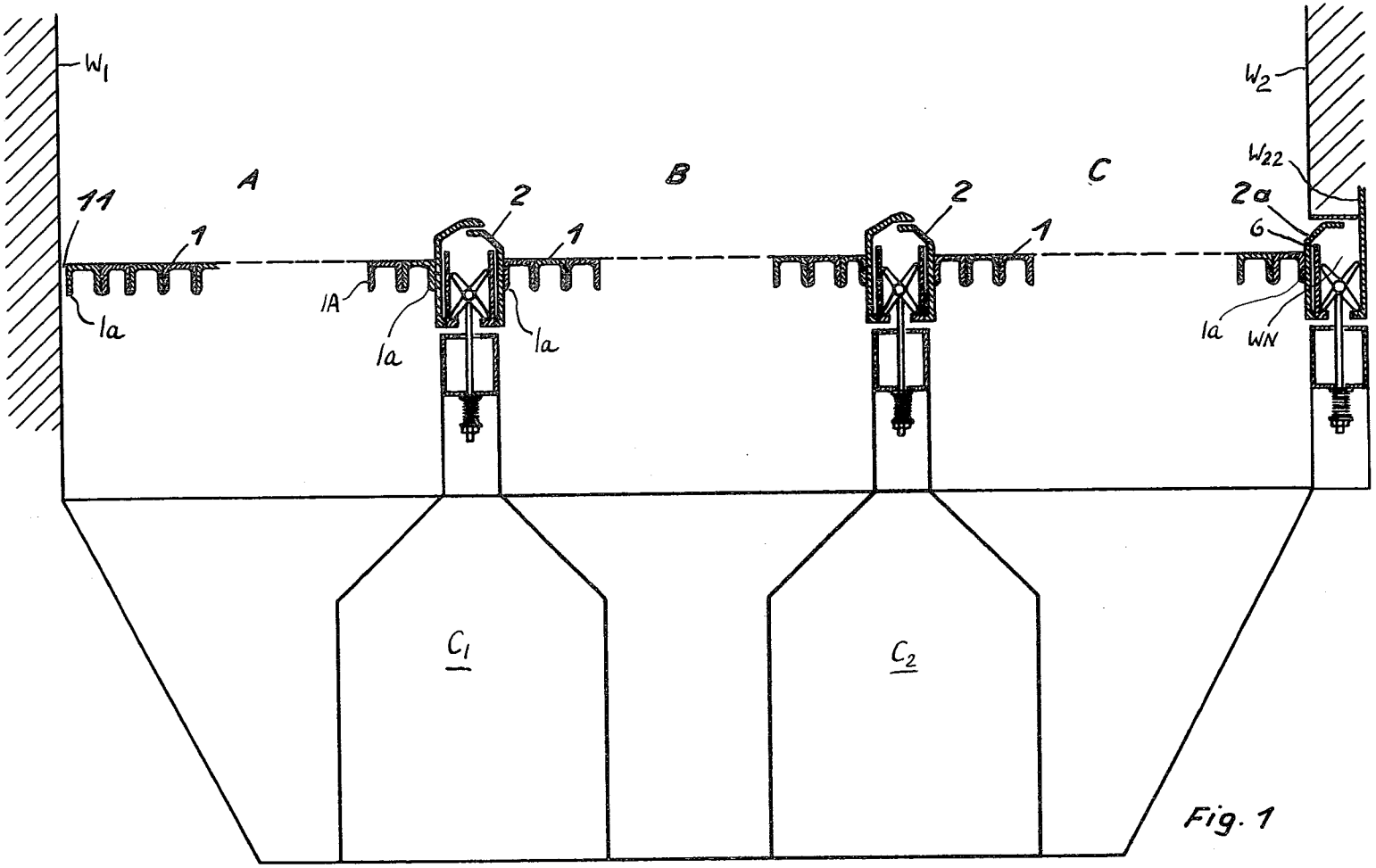
FIG. 1 is a schematic transverse vertical sectional view of a grate in an industrial furnace wherein the sections of the grate flank compensating apparatus embodying one form of the invention and a modified compensating apparatus is installed between the rightmost section and the adjacent wall of the furnace.

Referring first to FIG. 1, there is shown a portion of an industrial furnace having spaced apart wall members W1 and W2 which flank a composite grate including three longitudinally extending stretches or units A, B and C each consisting of a row of sections 1 having grate bars 1A and marginal portions 1a extending at right angles to the plane of FIG. 1. The left-hand marginal portions 1a of the sections 1 forming part of the leftmost unit A define with the neighboring furnace wall W1 a clearance or gap 11 whose width increases or decreases in response to thermally induced lateral contraction or expansion of the sections forming the unit A. The gaps between the units A–B and B–C are sealed by compensating apparatus 2 of the type shown in FIGS. 2 to 4, and the gap between the right-hand furnace wall W2 and the right-hand marginal portions 1a of the sections 1 forming part of the unit C is sealed by a modified compensating apparatus 2*a*. The apparatus 2 are designed to compensate for thermally induced lateral expansion or contraction of either of the neighboring grate sections 1a. The apparatus 2*a* acts in a single direction, i.e., it serves to compensate for lateral expansion or contraction of the sections 1 in the unit C, because the portion W22 of the furnace wall W2 is assumed to be stationary (not affected by temperature changes).

Figure 2:
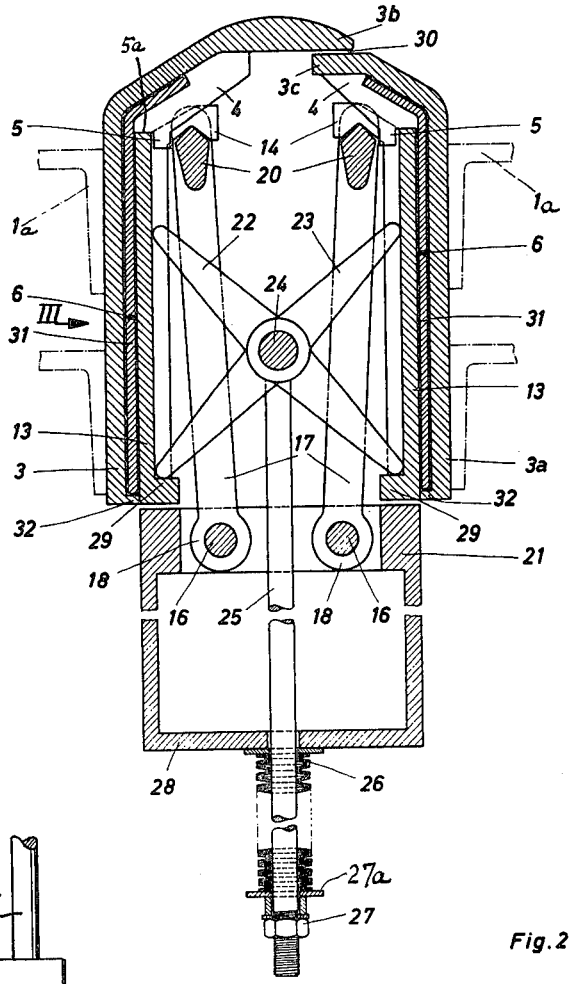
FIG. 2 is an enlarged transverse vertical sectional view of one of the two left-hand compensating apparatus of FIG. 1, the section being taken in the direction of arrows from the line II-II of FIG. 3.
Figure 3:
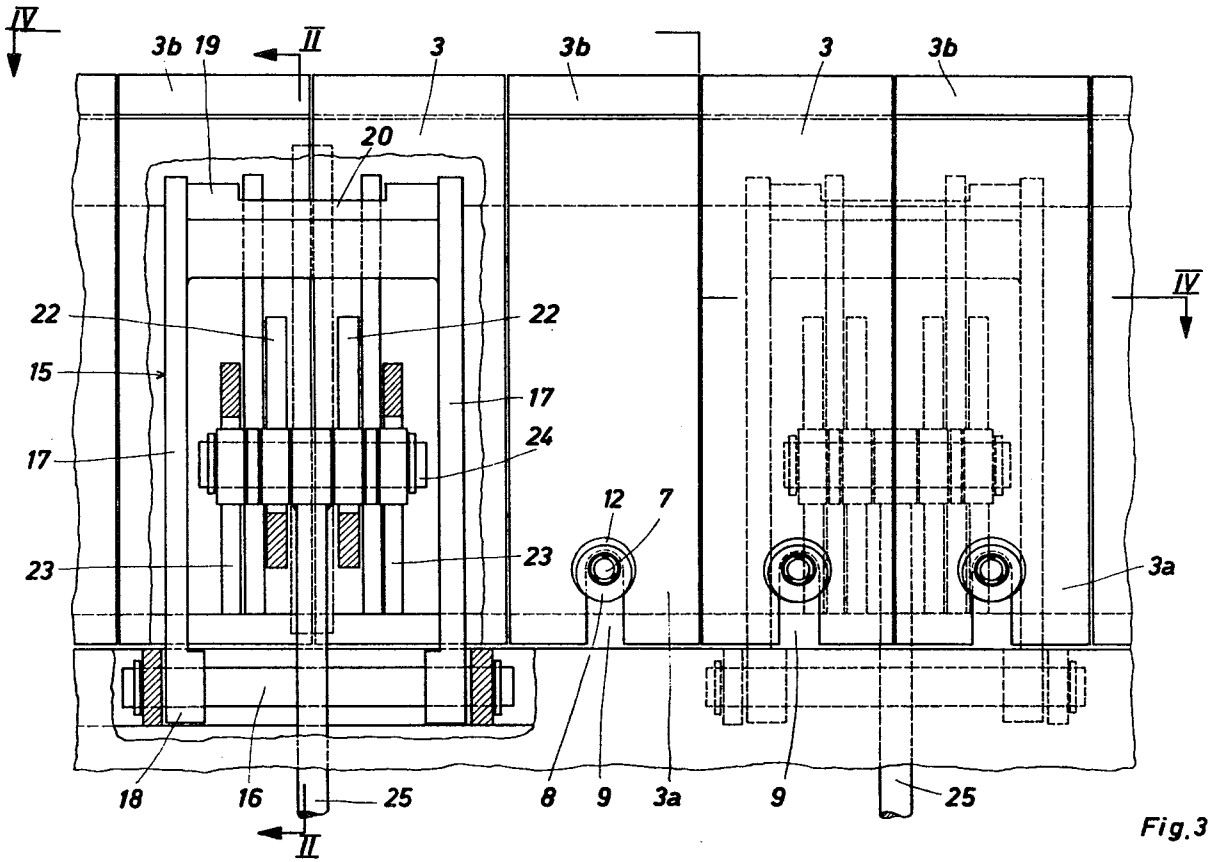
FIG. 3 is a side elevational view as seen in the direction of arrow III in FIG. 2, with portions of two side walls and one carrier partly broken away.
Figure 4:
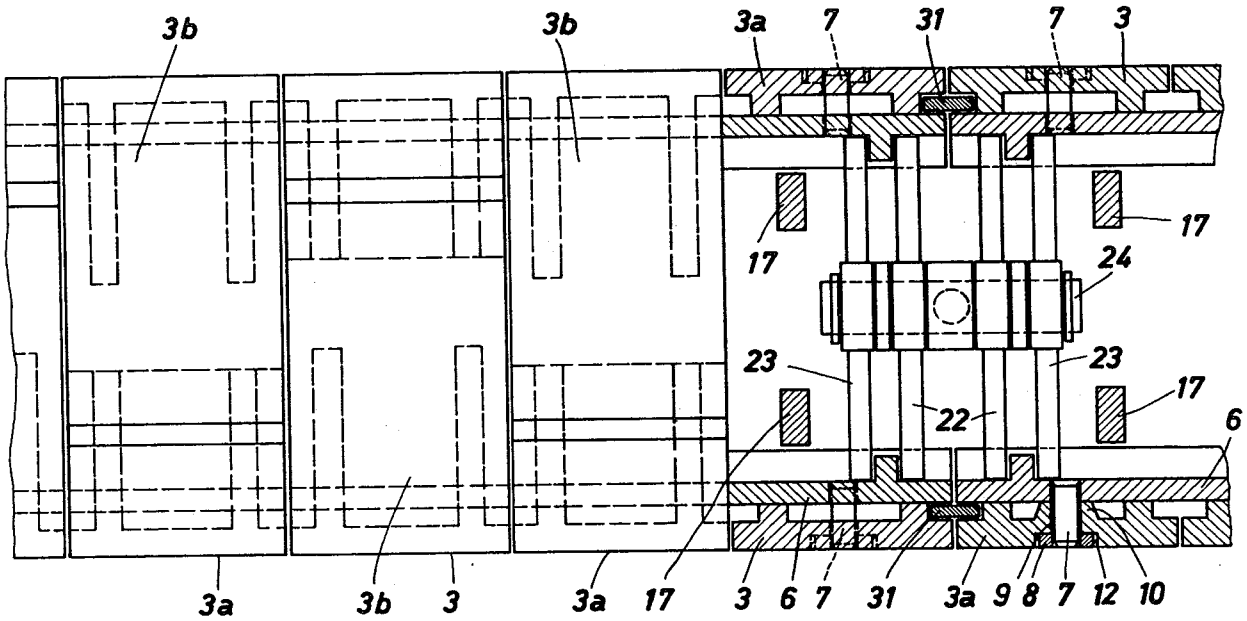
FIG. 4 is a partial top plan and partial horizontal sectional view as seen in the direction of arrows from the line IV—IV of FIG. 3.

The compensating apparatus of FIGS. 2 to 4 comprises two substantially parallel rows of shell-shaped side walls or cheeks 3 and 3*a*, In each of the two rows, the cheeks 3 alternate with the cheeks 3*a* (see FIGS. 3 and 4). The upper portions 3*b* of the cheeks 3 are relatively long and overlie relatively short upper portions 3*c* of the registering cheeks 3*a* (see FIGS. 2 and 4). The upper portions 3*b*, 3*c* of each pair of transversely aligned or registering cheeks 3, 3*a* define substantially horizontal outlet openings or orifices 30 for the discharge of a gaseous fluid (hot or cold air) which is admitted into the interior of the apparatus 2 in a manner not specifically shown in the drawing. Such heating or cooling fluid can be fed from below through the columns C1, C2 shown in FIG. 1 and serving to support the respective compensating apparatus 2. The two rows of cheeks 3 and 3*a* together constitute a substantially trough-shaped structure which is open at its underside and whose upper side is formed with openings or orifices 30 alternately serving to discharge streams of gaseous fluid into the space above the grate sections 1 of the unit A and grate sections 1 of the unit B (it being assumed that the compensating apparatus 2 of FIGS. 2 to 4 is the left-hand apparatus of FIG. 1).

The inner sides or surfaces of the cheeks 3, 3*a* (i.e., those sides which face away from the marginal portions 1*a* of neighboring structural elements or grate sections 1) are reinforced by transverse internal ribs 4 disposed in vertical planes extending at right angles to the direction of elongation of adjacent marginal portions 1*a*. The ribs 4 have downwardly extending projections 5 defining sockets 5*a* for reception of the upper edge portions of elongated plate-like carriers 6 which can be said to constitute component parts of means for biasing the cheeks 3 and 3*a* against the marginal portions 1*a* of the adjacent grate sections 1. In addition to the projections 5, the means for securing the cheeks 3, 3*a* to the respective carriers 6 comprises bolts 7 (shown in FIGS. 3 and 4) which are rigid with and extend laterally outwardly from the respective carriers, and washer-like retainers 8 which are mounted on the bolts 7 and are outwardly adjacent to the respective carriers. As shown in FIG. 3, each cheek has an open slot 9 the upper portion of which receives a median portion of the corresponding bolt 7 intermediate the carrier 6 and the respective retainer 8. In order to remove a damaged cheek 3 or 3*a*, such cheek is simply lifted off the respective carrier 6 whereby the socket 5*a* rises above the upper edge portion of the carrier and the slot 9 moves upwardly relative to the bolt 7. A shown in FIG. 4, the lower portions of inner sides of the cheeks 3 and 3*a* have thicker portions or ribs 10 and the slots 9 are provided in such ribs. FIG. 4 further shows that the retainers 8 are received in recesses 12 at the outer sides of the respective cheeks 3 or 3*a*.

The left-hand carriers 6 of FIG. 2 are identical with the right-hand carriers. Each such carrier comprises a metallic plate 13 which is elongated in the direction of the adjacent marginal portion 1*a* (i.e., at right angles to the plane of FIG. 2) and the outer side of which abuts against or is closely adjacent to the inner sides of the respective row of alternating cheeks 3, 3*a*. The height of plates 13 preferably equals or closely approximates the height of the major (vertical or nearly vertical) portions of the adjacent cheeks 3 and 3*a*, and the upper edge portions of such plates extend into the aforementioned sockets 5*a* behind the projections 5 of the ribs 4. The upper portions of the plates 13 are provided with inwardly extending hook-shaped extensions 14 having undersides defining substantially triangular sockets for elongated fulcra 20 forming part of inverted U-shaped supporting devices 15. The fulcra 20 are parallel to the marginal portions 1*a* of the adjacent grate sections 1.

The configuration of supporting devices 15 is shown n FIG. 3. Each device 15 comprises two spaced-apart downwardly extending flanges or legs 17 (see also FIG. 2) whose lower end portions 18 constitute eyelets and are turnable about horizontal pivots 16 forming part of a guide structure which further includes a hollow stationary frame 21. The horizontal web 19 of each supporting device 15 extends between the upper end portions of the respective legs 17 and its median portion 20 constitutes a fulcrum for the respective plate 13, i.e., the knife edge of such median portion extends into the triangular socket at the underside of the respective extension 14 (this is best shown in FIG. 2). Since the lower end portions 18 of the legs 17 are pivotable about the axes of the respective pivots 16, the guide structure including the pivots 16 and frame 21 enables the fulcra 20 to move sideways, i.e., at right angles to the marginal portins 1*a* of the neighboring grate sections 1. It will be noted that the pivots 16 are located at a level below the cheeks 3 and 3*a*. The substantially prismatic cross-sectional outlines of the fulcra 20 are best shown in FIG. 2.

The length of each plate 13 (as considered at right angles to the plane of FIG. 1 or 2) equals or closely approximates the length of the adjacent marginal portion 1*a* of a grate section 1. Each such plate 13 can be supported by two fulcra 20 which are preferably located close to the respective ends of the plate. Furthermore, the length of each plate 13 is preferably a whole multiple of the length of a cheek 3 or 3*a* (as considered at right angles to the plane of FIG. 1 or 2).

In addition to the carriers 6, the aforementioned means for yieldably biasing the two rows of alternating cheeks 3, 3*a*, against the marginal portions 1*a* of the adjacent grate sections 1 comprises pairs of two-armed levers 22, 23 having arms of identical length and being turnably mounted on horizontal shafts 24 each of which is coupled to one or more downwardly extending pull rods 25 which pass through suitable openings in the bottom wall 28 of the frame 21 and are urged downwardly by packages of dished springs 26 reacting against the underside of the bottom wall 28 and bearing against washers 27*a* surrounding the externally threaded lower end portions of the pull rods 26. The bias of the springs 26 can be adjusted by nuts 27 which mate with the rods 25. The rods 25 urge the respective shafts 24 sideways (downwardly, as viewed in FIG. 2) to thereby urge the tips of the arms of levers 22, 23 against the respective plates 13. This insures that each row of alternating cheeks 3, 3*a* abuts against the adjacent marginal portion 1*a* irrespective of the momentary width of the corresponding grate section 1, i.e., the distance between the two rows of cheeks 3, 3*a* increases when the width of the gaps between the respective units A and B increases as a result of cooling of the sections 1 in these units, and the distance between the two rows of cheeks decrease when the sections 1 of the units A and B are caused to expand laterally in response to heating.

The tips of the lower arms of levers 22 and 23 abut against inwardly extending ledges 29 at the lower ends of the respective plates 13. The springs 26 tend to reduce the angles between the left-hand and right-hand arms of the levers 22, 23 of FIG. 2, i.e., these springs constantly urge the plates 13 (and hence the two rows of alternating cheeks 3, 3*a*) away from each other.

The length of levers 22 and 23 is preferably selected in such a way that, when the distance between the two rows of cheeks is reduced to a minimum, the upper arms of the levers engage the respective plates 13 close to the upper portions (3*b*, 3*c*) of the cheeks 3 and 3*a*. As mentioned above, the lower arms of the levers 22 and 23 preferably bear against the ledges 29 regardless of the distance between the two rows of cheeks. It is further preferred to select the characteristics of the means for urging the tips of the arms of levers 22, 23 against the respective plates 13 in such a way that the force with which the cheeks 3, 3*a* are urged against the respective marginal portions 1*a* is constant or nearly constant under any and all operating conditions. In other words, the pressure between the two rows of cheeks and the adjacent sections 1 should remain constant or substantially constant regardless of the distance between such sections. This can be readily achieved by appropriate selection of the means for urging the shafts 24 downwardly as well as by the utilization of levers 22, 23 with relatively long arms so that the points at which the arms of the levers bear against the inner sides of the adjacent carriers 6 are distant from each other even when the sections 1 contract so that the cheeks of the two rows are allowed to assume positions at a maximum distance from each other. Moreover, such selection of the dimensions of levers 22, 23 insures that each cheek and each carrier is adequately biased and properly oriented regardless of the distance between the plates 13 of the left-hand and right-hand cheeks 6, as viewed in FIG. 2. Since the length of the arms of all levers 22, 23 is preferably the same, the carriers 6 are invariably moved sideways without any or with negligible change in inclination. Were the lower arms of the levers 22, 23 longer than the upper arms, each and every pivoting of levers about their respective shafts 24 would entail a change in the inclination of both carriers, i.e., clockwise pivoting of the lever 23 and anticlockwise pivoting of the lever 22 of FIG. 2 would result in pronounced inclination of both carriers 6 with respect to a vertical plane.

Figure 5:
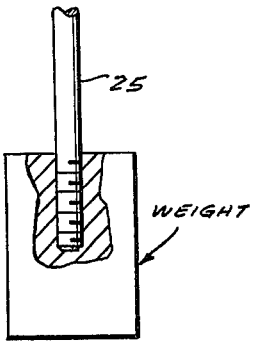
FIG. 5 is a fragmentary partly elevational and partly sectional view of a modified compensating apparatus.

The dished springs 26 can be replaced by other means for urging the shafts 24 sideways. Depending on the nature of installation in which the improved compensating apparatus are put to use, the shafts 24 can be pulled downwardly in pulsating fashion or with a constant force. The springs 26 have been found to be suited for the application of a constant force. The same result can be achieved by employing one or more weights (see FIG. 5) which are suspended from the pull rods 25 or are mounted directly on the shafts 24. Dished springs (as well as weights) exhibit the advantage that (especially if the packages of dished springs are relatively long) they can be subjected to very pronounced stresses while still allowing for pivotal movement of levers 22 and 23 through large angles, i.e., the bias upon the two rows of cheeks remains practically constant even if the cheeks of one row move close to or at a considerable distance from the other row and/or vice versa. Moreover, a package of dished springs occupies little room and can be installed in a space which is readily available in the furnace.

Figure 6:
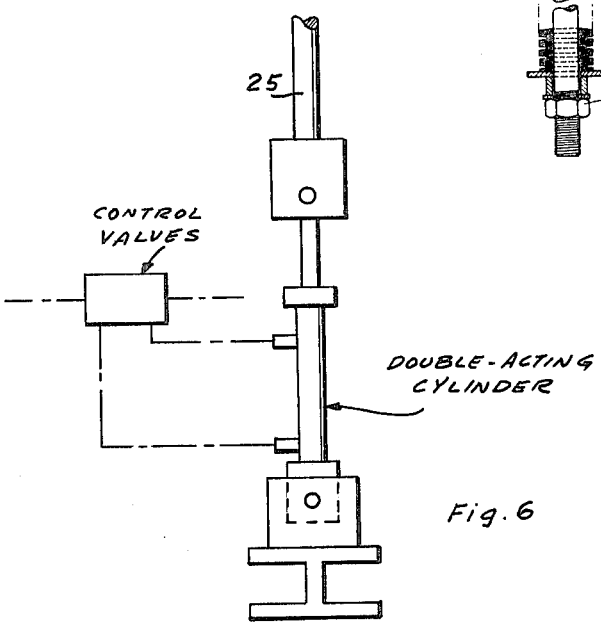
FIG. 6 is a fragmentary elevational view of a further compensating apparatus.

Pulsating forces can be applied by replacing the springs 26 with one or more fluid-operated (hydraulic or pneumatic) cylinder and piston units or analogous motors as well as with appropriate control valves (see FIG. 6) for admission and evacuation of fluid from the chambers of such motors at desired intervals. It is clear that fluid-operated motors can be used with equal advantage for the application of constant forces to each of the shafts 24.

It is preferred to install at least one pair of levers 22, 23 at each longitudinal end of a pair of plates 13. FIG. 4 shows that each shaft 24 carries two pairs of levers 22, 23 and the respective pull rod 25 is coupled to the shaft 24 in the space between the two pairs of levers. The construction which is shown in FIG. 4 is optional, i.e., each shaft 24 can carry a single pair of levers 22, 23 or two or more pairs of levers, and each shaft 24 can be urged sideways by two or more packages of dished springs (in other words, each shaft 24 can be coupled to two or more pull rods 25).

The aforediscussed orientation of openings 30 between the aligned cheeks 3, 3a insures that the cooling medium or combustion-promoting gas issuing from neighboring openings 30 alternately sweeps along the upper sides of the units A and B; this guarantees uniform combustion of coal, coke or other fuel which is supported by the units A and B.

The assembling of cheeks 3, 3a in such a way that each cheek 3 in one row is located opposite a cheek 3a in the other row and vice versa is particularly desirable in the apparatus (2) which are disposed between two neighboring units of the composite grate. The openings 30 of such apparatus discharge cooling or combustion promoting gases at a uniform rate into the spaces above the neighboring units to thus promote predictable and optimum combustion of fuel on the sections 1. Such combustion insures predictable (uniform) heating of both units and thus reduces the likelihood of excessive stressing of the one or the other row of cheeks. Non-uniform distribution of cooling or combustion-promoting gases would result in non-uniform heating of the respective units which could cause a malfunctioning of the compensating apparatus. Uniform heating of two units which flank an apparatus 2 is much less likely to cause jamming, wedging, cracking and/or breakage of cheeks.

The reinforcing ribs at the inner sides of the cheeks are not absoltely necessary; however, they reduce the likelihood of damage to the cheeks, especially when the compensating apparatus is used in installations wherein the temperature which develops on combustion of fuel reaches a very high value. The provision of ribs (4) which extend transversely of the adjacent marginal portions 1a enhances the stability of the cheeks and allows for more pronounced internal cooling of such parts.

In order to prevent the escape of cooling or heated gases between neighboring coplanar plates 13 of the carriers 6, the apparatus 2 of FIGS. 2–4 further comprises strip-shaped sealing members 31 which are received in grooves machined into the vertical edge faces of neighboring plates 13. The lower end faces of sealing strips 31 rest on inwardly extending ledges 32 of adjacent cheeks 3 and 3a. These strips are otherwise freely movable in the grooves so that they cannot interfere with relative movement between normally aligned plates 13. FIG. 2 shows that each strip 31 can extend upwardly beyond the plates 13 of the carriers 6. The strips 31 further serve to prevent entry of foreign matter into the interior of the apparatus.

The aforedescribed mounting of the two rows of alternating cheeks 3, 3a in such a way that the cheeks (together with their carriers 6) are swingable about the knife edges defined by the fulcra 20 and that the supporting devices 15 are turnable about the axes of the respective pivot members 16 enables each row of cheeks to readily follow the movements of neighboring grate sections in response to heating or cooling of the respective units. Furthermore, the fulcra 20 allows the rows of cheeks to change their orientation from vertical to inclined or vice versa. Such practically universal movability of each row of cheeks reduces the likelihood of jamming (e.g., wedging) as a result of excessive frictional engagement with the neighboring marginal portions 1a. The cheeks of one row can move independently of the cheeks of the other row or vice versa, i.e., simultaneous and identical heating or cooling of the units A and B will bring about a first type of movement of the two rows of cheeks whereas a cooling of the unit A or B simultaneously with heating of the unit B or A will cause an entirely different type of movement of the two rows of cheeks. For example, one row of cheeks can remain in a given position while the position and/or orientation of the other row of cheeks changes due to pronounced cooling or heating of the adjacent unit.

Fulcra in the form of knife edge bearings are preferred at this time because friction between the median portions 20 of the webs 19 of supporting devices 15 and the extensions 14 of the carriers 6 is practically nil. However, it is equally within the purview of the invention to employ different types of mobile supporting means for the carriers 6 and the respective rows of cheeks 3, 3a. For example, the extensions 14 can be replaced by eyelets and the median portions 20 may constitute cylindrical rods which are surrounded by the respective eyelets.

The placing of pivots 16 for the supports 15 at a level below the cheeks 3 and 3a is desirable and advantageous because the relatively long flages or legs 17 of the supporting devices 15 insure that each movement of a row of cheeks toward or away from the other row of cheeks has a relatively small vertical component, i.e., the outer sides of the cheeks perform negligible vertical movements relative to the adjacent marginal portions 1a so that the likelihood of excessive frictional engagement between 3 and 3a on the one hand and 1a on the other hand (and eventual jamming of cheeks) is practically nil. This will be readily appreciated by looking at FIG. 2. If the left-hand leg 17 is caused to pivot counterclockwise, the left-hand cheek 3 moves sideways and the extent of its downward movement relative to the adjacent grate section or sections 1 is negligible. This is attributable to substantial length of the legs 17. Furthermore, the placing of pivots 16 at a level below the cheeks 3 and 3a (i.e., at a considerable distance from the zone where fuel on the grate units A and B is combusted) contributes to longer useful life of the pivots because the temperature of air in the region immediately surrounding the pivots 16 is much lower than the temperature in the region of the upper end portions of the cheeks. By being shielded from elevated temperatures, the pivots 16 insure that the eyelets 18 can readily turn therearound so that the two rows of cheeks invariably permit the left-hand and right-hand grate sections 1 of FIG. 2 to move toward or away from each other. The webs 19 of the inverted U-shaped supporting devices 15 are preferably long so that each fulcrum 20 provides a reliable support for the respective plate 13.

As a rule, the cheeks 3 and 3a consist of a highly heat- and wear-resistant material, e.g., a metallic casting. Such material is often rather brittle and thus cannot stand pronounced and highly concentrated deforming stresses, e.g., stresses of the type which would be transmitted by the tips of arms of the levers 22 and 23 in the absence of plates 13. This is the reason that the improved compensating apparatus are preferably provided with plate-like carriers whose outer sides are in larger surface-to-surface contact with the respective rows of cheeks 3, 3a and whose inner sides take up stresses transmitted by the levers 22 and 23. The rows of cheeks shield the plates 13 from excessive thermal stresses so that the plates can be made of a material which is or might be less resistant to heat but is much less brittle than the material of the cheeks.

The aforediscussed characteristics of the cheeks 3 and 3a (namely, pronounced resistance to heat and wear but relatively low resistance to deforming stresses) render it advisable to employ relatively small (narrow) cheeks so that eventual breakage of a single cheek does not entail substantial costs for replacement. Furthermore, and as explained above, the means 5, 5*a*, 7 and 8 for securing the cheeks to the respective carriers are designed in such a way that each cheek can be readily detached from the adjacent plate 13 in a simple and time-saving manner.

Since the length of a carrier 6 preferably equals or approximates the length of the marginal portion 1*a* of the adjacent laterally expansible or contractible structural element 1, and since the units of the grate in an industrial furnace often consist of sections which are disposed end-to-end, a row of cheeks 3, 3*a* on a given carrier 6 can move independently of the row of cheeks on the preceding or next-following carrier (as considered at right angles to the plane of FIG. 1). This reduces the likelihood of damage to the compensating apparatus since it can readily follow different expansion or contration of spaced-apart portions of one and the same unit. For example, each of the three units shown in FIG. 1 may comprise two or more stages and each stage is preferably adjacent to a discrete carrier 6. Such construction insures that the likelihood of development of gaps between the stages of neighboring units is practically nil aind also that the components of the apparatus are less likely to undergo breakage, cracking or excessive deformation. The extent of expansion or contraction of one stage is often quite different from the extent of expansion or contraction of the adjacent stage in one and the same unit.

The compensating apparatus 2*a* of FIG. 1 is a simplified version of the apparatus 2 shown in FIGS. 2 and 4. The portion W22 of the furnace wall W2 constitutes a stationary structural element which, unlike the adjacent grate section 1 of the unit C, is not movable laterally in response to heating or cooling. The levers of the biasing means for the single row of cheeks in the apparatus 2*a* bear against the respective carrier 6 and against the wall portion W22. The entire apparatus 2*a* can be installed in a recess or niche WN of the wall W2.

The improved apparatus are susceptible of many further modifications without departing from the spirit of the invention. For example, and especially if the cheeks 3, 3*a* consist of a material which can stand reasonable deforming stresses, the carriers 6 can be omitted so that the levers 22, 23 or other components of the biasing means bear directly against the inner sides of the cheeks. The strips 31 are then installed between the neighboring cheeks of each row and the lower arms of the levers 22, 23 bear directly against the ledges 32.

Furthermore, the improved apparatus need not be installed in the interior of a furnace. Such apparatus can be used with equal advantage between expansible and contractible sections of structures on which fuel is conveyed toward the combustion chamber of a furnace or the like, or of structures which receive hot combustion products from a furnace.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore such adaptations should and are intended to be comprehended within the meaning and range of equivalence of the claims.

What is claimed is:

1. Apparatus for compensating for thermally induced dimensional changes of sections of grates in industrial furnaces or of analogous structural elements of the type having an elongated marginal portion extending transversely of the direction of thermally induced expansion or contraction, comprising a side wall adjacent to the marginal portion of a structural element which is subject to expansion or contraction; means for swingably supporting said side wall, including a fulcrum extending in substantial parallelism with the marginal portion of said elements; guide means for said supporting means, said fulcrum being movable with respect to said guide means substantially at right angles to the marginal portion of said element; and means for yieldably biasing said side wall against the marginal portion of said element.

2. Apparatus as defined in claim 1, wherein said guide means includes a pivot which is substantially parallel to the marginal portion of said element and said supporting means includes a portion which is turnable about the axis of said pivot and mounts said fulcrum.

3. Apparatus as defined in claim 2, wherein said pivot is located at a level below said side wall.

4. Apparatus as defined in claim 2, wherein said supporting means constitutes an inverted U-shaped member having two downwardly extending legs which constitute said turnable portion and a web extending between said legs, said fulcrum forming part of said web.

5. Apparatus as defined in claim 1, wherein said biasing means comprises a carrier which is adjacent to said side wall opposite the marginal portion of said element.

6. Apparatus as defined in claim 5, wherein said carrier comprises a portion which is swingably mounted on said fulcrum and further comprising means for securing said side wall to said carrier.

7. Apparatus as defined in claim 6, wherein said carrier is elongated, as considered in the direction of elongation of the marginal portion of said element, and further comprising at least one second side wall disposed end-to-end to said first mentioned side wall and means for securing said second side wall to said carrier.

8. Apparatus as defined in claim 7, wherein the length of said carrier, as considered in said last mentioned direction, is a whole multiple of the length of a side wall.

9. Apparatus as defined in claim 7 for compensating for dimensional changes of structural elements having marginal portions of predetermined length, wherein the length of said carrier, as considered in said last mentioned direction, at least closely approximates said predetermined length.

10. Apparatus as defined in claim 5, wherein said biasing means further comprises a second carrier which is disposed end-to-end to and is substantially coplanar with said first mentioned carrier, and further comprising sealing means innterposed between said carriers.

11. Apparatus as defined in claim 1, wherein said side wall has first and second surfaces respectively adjacent to and facing away from said element and reinforcing means provided on said second surface.

12. Apparatus as defined in claim 11, wherein said reinforcing means comprises at least one rib extending transversely of the marginal portion of said element.

13. Apparatus as defined in claim 1 for compensating for thermally induced dimensional changes of structural elements which include said first mentioned structural element and a second structural element having a marginal portion spaced apart from the marginal portion of said first mentioned structural element, and further comprising a second side wall adjacent to the marginal portion of said second element, and means for swingably supporting said second side wall including a second fulcrum substantially parallel to said first mentioned fulcrum, said second fulcrum being movable with respect to said guide means substantially at right angles to the marginal portion of said second element and said biasing means including means for yieldably urging said second side wall against the marginal portion of said second element.

14. Apparatus as defined in claim 13, wherein said side walls have upper portions one of which overlies the other upper portion and deines therwith an opening arranged to discharge a gaseous fluid which is fed into the space between said side walls.

15. Apparatus as defined in claim 14, further comprising third and fourth side walls respectively disposed end-to-end with said first mentioned and second side walls, said third and fourth side walls having upper portions one of which overlies the other and defines therewith a second opening, one of said openings being arranged to discharge gaseous fluid in a direction toward said first mentioned structural element and the other of said openings being arranged to discharge gaseous fluid in a direction toward said second structural element.

16. Apparatus as defined in claim 13, wherein said biasing means includes a plurality of levers each having a first arm arranged to move one of said side walls away from the other side wall and a second arm arranged to move said other side wall away from said one side wall, a common pivot member for said levers, and means for urging said pivot member sideways to thereby urge said arms toward the respective side walls.

17. Apparatus as defined in claim 16, wherein said means for urging said pivot member sidewals includes a pull rod and means for axially stressing said rod.

18. Apparatus as defined in claim 16, wherein each of said side walls has an upper portion and a lower portion, said arms of said levers including upper arms which are adjacent to said upper portions and lower arms which are adjacent to said lower portions of the respective side walls when said side walls are moved nearest to each other, said means for urging said pivot member sideways including means for maintaining the pressure between said side walls and the respective marginal portions within a predetermined range regardless of the spacing between said side walls.

19. Apparatus as defined in claim 16, wherein all of said arms are of identical length.

20. Apparatus as defined in claim 1, wherein said biasing means comprises means for permanently urging said side wall against the marginal portion of said element.

21. Apparatus as defined in claim 1, wherein said biasing means includes means for biasing said side wall against the marginal portion of said element in pulsating fashion.

22. Apparatus as defined in claim 1, wherein said biasing means comprises a package of dished springs.

23. Apparatus as defined in claim 1, wherein said biasing means comprises a weight.

24. Apparatus as defined in claim 1, wherein said biasing means comprises a fluid-operated motor.

25. Apparatus as defined in claim 1, wherein said biasing means comprises a pair of pivotable levers having arms adjacent to said side wall opposite said element, said side wall having a stop against which one of said arms abuts in all angular positions of the respective lever, said biasing means further comprising a common pivot member for said levers and means for biasing said pivot member sideways to thereby urge said side wall against the marginal portion of said element through the medium of said arms.

* * * * *